US012704288B2

(12) United States Patent
Garrett et al.

(10) Patent No.: US 12,704,288 B2
(45) Date of Patent: Aug. 11, 2026

(54) ARRANGEMENT FOR REFRIGERANT LEAK MANAGEMENT

(71) Applicant: Tyco Fire & Security GmbH, Neuhausen am Rheinfall (CH)

(72) Inventors: D'Marcus Letrey Garrett, Wichita, KS (US); Elmer Wayne Romero, Oxford, KS (US); Amr Aly, Wichita, KS (US); Selin Nur Ergul, Wichita, KS (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 180 days.

(21) Appl. No.: 18/593,046

(22) Filed: Mar. 1, 2024

(65) Prior Publication Data

US 2024/0295339 A1 Sep. 5, 2024

Related U.S. Application Data

(60) Provisional application No. 63/449,219, filed on Mar. 1, 2023.

(51) Int. Cl.
*F24F 11/89* (2018.01)
*F24F 11/36* (2018.01)

(52) U.S. Cl.
CPC ..... *F24F 11/89* (2018.01); *F24F 11/36* (2018.01)

(58) Field of Classification Search
CPC ..... F24F 11/36; F24F 11/89
See application file for complete search history.

(56) References Cited

U.S. PATENT DOCUMENTS

| | | | | |
|---|---|---|---|---|
| 3,831,670 | A * | 8/1974 | Mullings | F28B 1/06 62/515 |
| 3,910,061 | A * | 10/1975 | Irwin | F24F 13/22 62/286 |
| 5,279,360 | A * | 1/1994 | Hughes | F28F 9/0243 29/890.07 |
| 5,341,870 | A * | 8/1994 | Hughes | F28F 3/025 165/110 |
| 10,234,164 | B2 | 3/2019 | Takeuchi et al. | |
| 10,274,219 | B2 | 4/2019 | Makino et al. | |
| 10,724,760 | B2 | 7/2020 | Iwatsuki et al. | |
| 11,125,457 | B1 * | 9/2021 | Alfano | F24F 11/36 |
| 11,441,813 | B2 | 9/2022 | Tsuji et al. | |
| 2005/0211415 | A1 * | 9/2005 | Arts | B01D 46/62 165/59 |
| 2008/0104960 | A1 * | 5/2008 | Lomax | F22B 21/16 165/145 |

(Continued)

FOREIGN PATENT DOCUMENTS

| | | |
|---|---|---|
| AU | 2015220023 B2 | 10/2017 |
| AU | 2016237157 B2 | 8/2018 |

(Continued)

*Primary Examiner* — Henry T Crenshaw
(74) *Attorney, Agent, or Firm* — Fletcher Yoder, PC

(57) ABSTRACT

A heating, ventilation, and/or air conditioning (HVAC) unit includes a casing, a heat exchanger disposed in the casing and comprising a V-shaped arrangement having (e.g., formed by) a first leg and a second leg, a delta plate extending from the first leg to the second leg, and a refrigerant sensor configured to detect a refrigerant leak associated with the HVAC unit, wherein the refrigerant sensor is coupled to the delta plate.

19 Claims, 11 Drawing Sheets

(56) References Cited

U.S. PATENT DOCUMENTS

| | | | | |
|---|---|---|---|---|
| 2013/0333401 | A1* | 12/2013 | Long | H05K 7/20818 62/62 |
| 2017/0350614 | A1* | 12/2017 | Nagaoka | F24F 1/0014 |
| 2019/0137139 | A1* | 5/2019 | Miller | F24D 5/02 |
| 2021/0231329 | A1* | 7/2021 | Shirai | F25B 1/00 |
| 2022/0003443 | A1 | 1/2022 | Kobayashi et al. | |
| 2023/0358460 | A1* | 11/2023 | Tang | F25D 21/08 |

FOREIGN PATENT DOCUMENTS

| | | | |
|---|---|---|---|
| CN | 209310205 | U | 8/2019 |
| CN | 112805513 | A | 5/2021 |
| CN | 114811917 | A | 7/2022 |
| CN | 114080527 | B | 11/2022 |
| EP | 3372923 | A1 | 9/2018 |
| EP | 3115716 | B1 | 7/2019 |
| EP | 3276284 | B1 | 8/2019 |
| EP | 3859252 | A1 | 8/2021 |
| EP | 3998443 | A4 | 8/2022 |
| GB | 2561740 | C | 11/2021 |
| JP | 6233546 | B2 | 11/2017 |
| JP | 6375639 | B2 | 8/2018 |
| JP | 6576470 | B2 | 9/2019 |
| JP | 6614389 | B1 | 12/2019 |
| JP | 2020051732 | A | 4/2020 |
| MY | 192273 | A | 8/2022 |
| WO | 2022029891 | A1 | 2/2022 |

* cited by examiner

ARRANGEMENT FOR REFRIGERANT LEAK MANAGEMENT

CROSS-REFERENCE TO RELATED APPLICATIONS

This application claims priority from and the benefit of U.S. Provisional Patent Application No. 63/449,219, entitled "AN ARRANGEMENT FOR REFRIGERANT LEAK MANAGEMENT," filed Mar. 1, 2023, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

A heating, ventilation, and/or air conditioning (HVAC) system provides proper ventilation and maintains air quality and desired temperature in a confined space, for example, in a commercial or residential building. The HVAC system may circulate a refrigerant through a closed loop comprising a compressor, a condenser, an expansion device, and an evaporator, which change pressure and/or temperature conditions of the refrigerant at various location of the closed loop. The refrigerant in the evaporator, for example, is utilized to extract heat from (e.g., cool) an airflow via thermal (e.g., heat) exchange, where the airflow is routed to the confined space to condition the confined space.

Certain traditional refrigerants have a relatively high global warming potential (GWP) that can negatively impact the environment. Accordingly, certain HVAC systems have begun to employ alternate refrigerants with a relatively low GWP. However, these alternate refrigerants may be mildly flammable and/or cause certain negative effects when leaked from the closed loop of the HVAC system. To the extent certain traditional configurations employ mechanisms for detecting and/or mitigating refrigerant leaks, such mechanisms may be expensive to manufacture, install, and/or operate, incompliant with rules and regulations associated with use of the alternate refrigerant(s), and/or inconsistent/inaccurate in refrigerant leak detection. Additionally or alternatively, such mechanisms may substantially enlarge a footprint of the HVAC system or unit(s) thereof. Accordingly, improved systems and methods are desired.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a heating, ventilation, and/or air conditioning (HVAC) unit includes a casing, a heat exchanger disposed in the casing and comprising a V-shaped arrangement having (e.g., formed by) a first leg and a second leg, a delta plate extending from the first leg to the second leg, and a refrigerant sensor configured to detect a refrigerant leak associated with the HVAC unit, wherein the refrigerant sensor is coupled to the delta plate.

In an embodiment, a heating, ventilation, and/or air conditioning (HVAC) unit includes a casing defining a casing interior, a blower housing disposed in the casing interior and configured to receive a blower, a heat exchanger disposed in the casing interior and comprising a V-shaped arrangement having (e.g., formed by) a first leg and a second leg, a delta plate extending from the first leg to the second leg, and a refrigerant leak mitigation control board assembly disposed in the casing interior and coupled to the delta plate, the casing, or the blower housing.

In an embodiment, a heat exchanger of an indoor unit includes a V-shaped heat exchanger having (e.g., formed by) a first leg and a second leg, a delta plate extending from the first leg to the second leg, a refrigerant sensor coupled to the delta plate and configured to detect a refrigerant leak, and a refrigerant leak mitigation control board assembly configured to receive data indicative of the refrigerant leak from the refrigerant sensor.

BRIEF DESCRIPTION OF THE DRAWINGS

Various aspects of this disclosure may be better understood upon reading the following detailed description and upon reference to the drawings in which.

DETAILED DESCRIPTION

Figure 1:
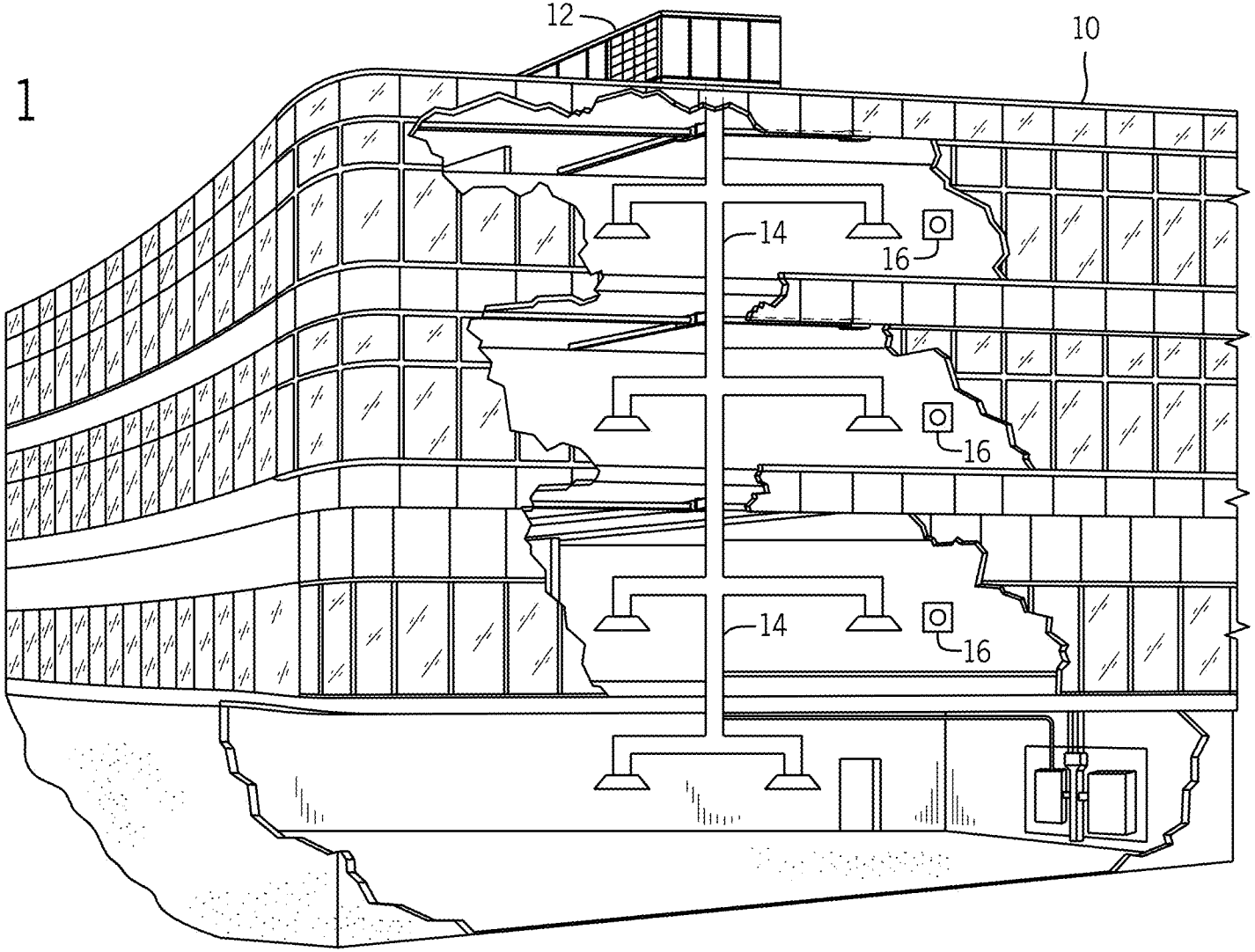
FIG. 1 is a perspective view of an embodiment of a heating, ventilation, and/or air conditioning (HVAC) system for building environmental management that may employ one or more HVAC units, in accordance with aspects of the present disclosure.

One or more specific embodiments of the present disclosure will be described below. These described embodiments are examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "approximately," "generally," and "substantially," and so forth, are intended to convey that the property value being described may be within a relatively small range of the property value, as those of ordinary skill would understand. For example, when a property value is described as being "approximately" equal to (or, for example, "substantially similar" to) a given value, this is intended to mean that the property value may be within +/−5%, within +/−4%, within +/−3%, within +/−2%, within +/−1%, or even closer, of the given value. Similarly, when a given feature is described as being "substantially parallel" to another feature, "generally perpendicular" to another feature, and so forth, this is intended to mean that the given feature is within +/−5%, within +/−4%, within +/−3%, within +/−2%, within +/−1%, or even closer, to having the described nature, such as being parallel to another feature, being perpendicular to another feature, and so forth. Further, it should be understood that mathematical terms, such as "planar," "slope," "perpendicular," "parallel," and so forth are intended to encompass features of surfaces or elements as understood to one of ordinary skill in the relevant art, and should not be rigidly interpreted as might be understood in the mathematical arts. For example, a "planar" surface is intended to encompass a surface that is machined, molded, or otherwise formed to be substantially flat or smooth (within related tolerances) using techniques and tools available to one of ordinary skill in the art. Similarly, a surface having a "slope" is intended to encompass a surface that is machined, molded, or otherwise formed to be oriented at an angle (e.g., incline) with respect to a point of reference using techniques and tools available to one of ordinary skill in the art.

The present disclosure is directed to heating, ventilation, and/or air conditioning (HVAC) systems. More particularly, the present disclosure is directed to positions of a refrigerant sensor and a refrigerant leak mitigation control board assembly of the HVAC system (e.g., within a unit of the HVAC system, such as an indoor unit).

A heating, ventilation, and/or air conditioning (HVAC) system provides proper ventilation and maintains air quality and desired temperature in a confined space, for example, in a commercial or residential building. The HVAC system may circulate a refrigerant through a closed loop comprising a compressor, a condenser, an expansion device, and an evaporator. Refrigerant in the evaporator, for example, is utilized to cool an airflow via thermal (e.g., heat) exchange to condition the confined space.

In accordance with the present disclosure, the refrigerant employed in the HVAC system may include a relatively low global warming potential (GWP). For example, the refrigerant may be an A2L refrigerant, such as a non-toxic, hydrofluoroolefin (HFO) based refrigerant (e.g., R-454B), with relatively low (e.g., mild) flammability. Other types of refrigerant area also possible in accordance with the present disclosure. In order to protect against undesirable effects of the refrigerant leaking from the closed loop of the HVAC system, presently disclosed embodiments include a refrigerant sensor configured to detect a refrigerant leak from the closed loop, and a refrigerant leak mitigation control board assembly configured to receive data indicative of the refrigerant leak from the refrigerant sensor.

The refrigerant sensor and the refrigerant leak mitigation control board assembly may be disposed in or on an indoor unit of the HVAC system. As an example, the indoor unit may include a casing defining a casing interior, and a heat exchanger disposed in the casing interior. The heat exchanger may include a V-shaped arrangement (e.g., coil, evaporator coil, coil assembly) having a first leg and a second leg forming a vertex of the V-shaped arrangement, where tubes or channels of the V-shaped arrangement are configured to receive the refrigerant (e.g., R-454B). A delta plate may extend from the first leg to the second leg. In some embodiments, the delta plate at least partially defines an air flow path through the heat exchanger, such that a heat exchange relationship is established between an air flow through the air flow path and the refrigerant in the heat exchanger.

The refrigerant sensor may be disposed on (e.g., coupled to) the delta plate. For example, the delta plate may include a first end at or adjacent to the vertex of the V-shaped arrangement, and a second end opposing the first end. In some embodiments, the second end is adjacent to a drain pan configured to receive liquid condensate (e.g., gravity-fed condensate) from, for example, an outer surface of heat exchanger. The refrigerant sensor may be disposed at a position on the delta plate closer to the second end than the first end. That is, the refrigerant sensor may be coupled to the delta plate at the position adjacent to the drain pan. Because leaked refrigerant tends to travel and/or accumulate relatively close to the drain pan (e.g., at or toward a bottom of the indoor unit), the position of the refrigerant sensor relatively close to the second end of the delta plate and/or relatively close to the drain pan enables consistent detection of any such refrigerant leak.

In some embodiments, the refrigerant sensor is positioned in a corner of the delta plate. For example, the refrigerant sensor may be offset from a central axis extending across the delta plate from the vertex of the V-shaped arrangement (e.g., at the first end of the delta plate) to the second end of the delta plate. Such positioning of the refrigerant sensor may prevent interference with and/or required relocation of other aspects of the indoor unit (e.g., aspects of the indoor unit spatially overlapping with the central axis across the delta plate). Additionally or alternatively, such positioning of the refrigerant sensor (e.g., at a corner of the delta plate) may enable improved refrigerant leak detection based on a proximity between the refrigerant sensor and the first or second leg of the V-shaped arrangement. In certain embodiments, desirable positioning of the refrigerant sensor may depend on a type of the heat exchanger employed in the indoor unit, such as a tube-and-fin heat exchanger or a microchannel heat exchanger.

The refrigerant leak mitigation control board assembly may be coupled to the delta plate, to a blower housing corresponding to a blower positioned in the casing interior, or to the casing (e.g., an inner casing surface facing the casing interior). Such positioning of the refrigerant leak mitigation control board assembly may prevent interference with and/or required relocation of other aspects of the indoor unit. In embodiments employing the refrigerant leak mitigation control board assembly disposed on the delta plate, the refrigerant leak mitigation control board assembly may be coupled to the delta plate at an additional position differing from the position of the refrigerant sensor, such as a mid-section of the delta plate, closer to the first end of the delta plate than the second delta plate, or both. Additionally or alternatively, the refrigerant leak mitigation control board assembly overlaps with the central axis described above. Other locations of the refrigerant sensor and/or the refrigerant leak mitigation control board assembly are also possible and will be described with respect to the drawings. In certain embodiments, desirable positioning of the refrigerant leak mitigation control board assembly may also depend on a type of the heat exchanger employed in the indoor unit, such as a tube-and-fin heat exchanger or a microchannel heat exchanger.

In general, presently disclosed embodiments may improve refrigerant leak detection (e.g., accuracy and consistency), reduce cost associated with refrigerant leak detection, improve compliance with rules and regulations related to employing certain types of refrigerants (e.g., A2L refrigerants, low GWP refrigerants, hydrofluoroolefin [HFO] based refrigerants such as R-454B, etc.) in the HVAC system, and/or reduce a footprint of the HVAC system relative to traditional configurations.

Turning now to the drawings, FIG. 1 illustrates a heating, ventilation, and/or air conditioning (HVAC) system for building environmental management that may employ one or more HVAC units. The HVAC system of FIG. 1 may also employ present embodiments to limit overflow of condensate into ductwork. In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air-cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream. A heat exchanger of the HVAC unit 12, such as one in a refrigeration circuit, may cause generation of condensate that is collected and removed in accordance with embodiments of the presently disclosed drain system and shield.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
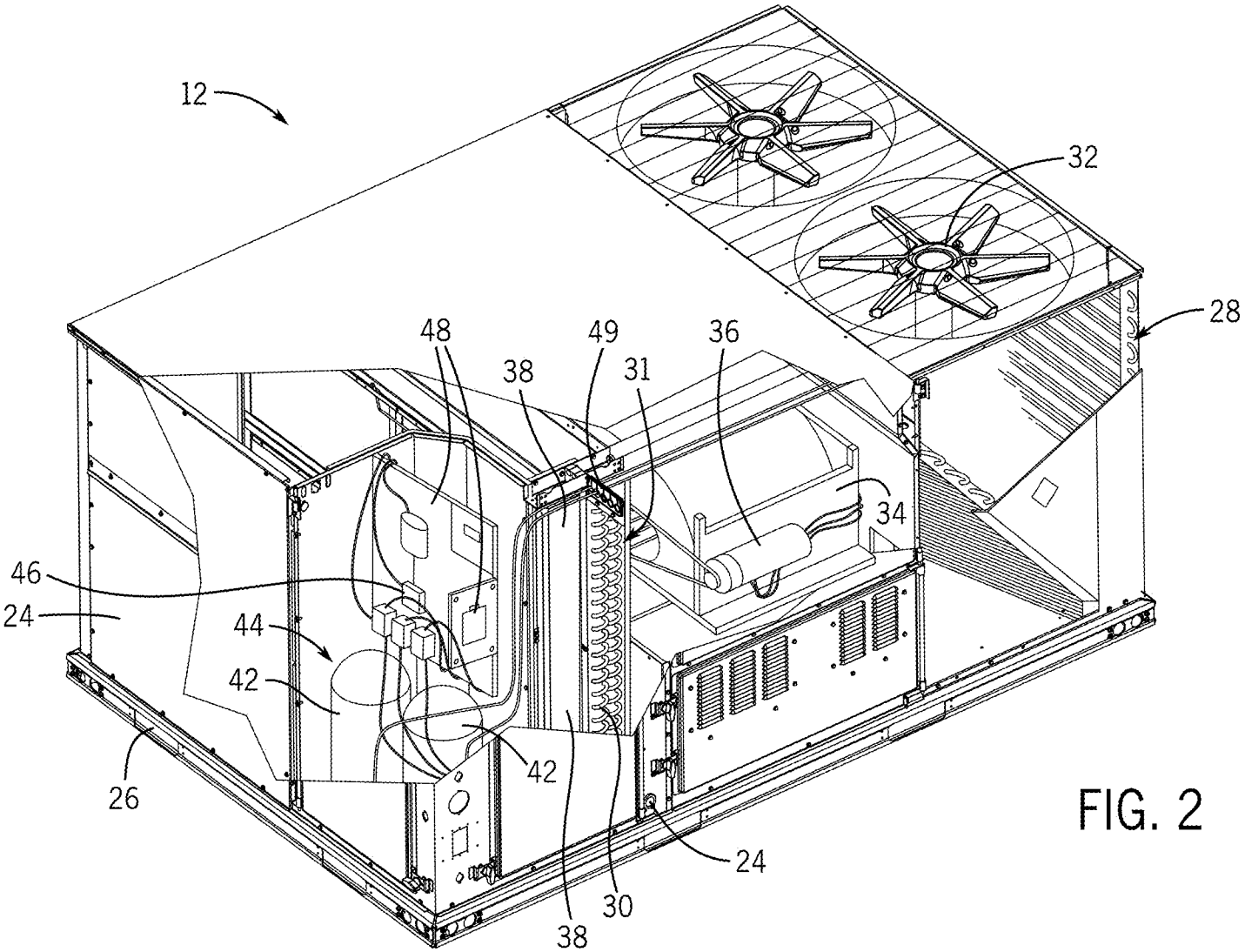
FIG. 2 is a perspective view of an embodiment of an HVAC unit of the HVAC system of FIG. 1, in accordance with aspects of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Such heat exchangers may cause accumulation of condensate from environmental air that is addressed by embodiments of the presently disclosed drainage system. Tubes within the heat exchangers 28 and 30 may circulate a working fluid, such as R-410A, through the heat exchangers 28 and 30. The tubes may be of various types, such as multichannel tubes, microchannel tubes, conventional copper or aluminum tubing, and so forth. Together, the heat exchangers 28 and 30 may implement a thermal cycle in which the working fluid undergoes phase changes and/or temperature changes as it flows through the heat exchangers 28 and 30 to produce heated and/or cooled air. For example, the heat exchanger 28 may function as a condenser where heat is released from the working fluid to ambient air, and the heat exchanger 30 may function as an evaporator where the working fluid absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the working fluid before the working fluid enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
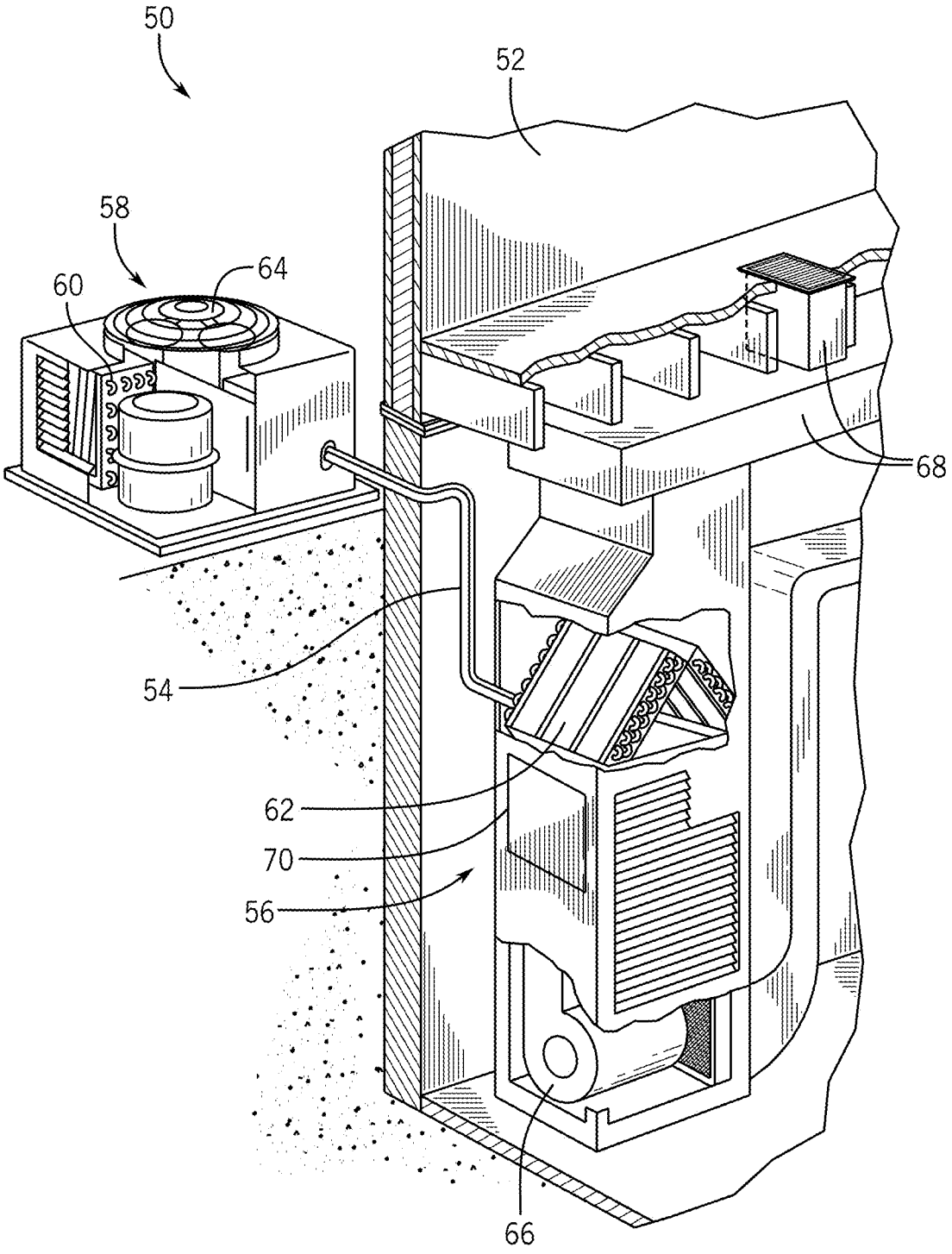
FIG. 3 is a perspective view of an embodiment of a residential split heating and cooling system, in accordance with aspects of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include working fluid conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The working fluid conduits 54 transfer working fluid between the indoor unit 56 and the outdoor unit 58, typically transferring primarily liquid working fluid in one direction and primarily vaporized working fluid in an opposite direction.

When the system shown in FIG. 3 is operating as an air conditioner, a heat exchanger 60 in the outdoor unit 58 serves as a condenser for re-condensing vaporized working fluid flowing from the indoor unit 56 to the outdoor unit 58 via one of the working fluid conduits 54. In these applications, a heat exchanger 62 of the indoor unit functions as an evaporator. Specifically, the heat exchanger 62 receives liquid working fluid, which may be expanded by an expansion device, and evaporates the working fluid before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. In accordance with present embodiments, the indoor unit 56 includes a drain system in accordance with the present disclosure to limit or block condensate generated by cooling of atmospheric air, for example, from entering the ductwork 68. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate working fluid and thereby cool air entering the outdoor unit 58 as the air passes over outdoor the heat exchanger 60. The indoor heat exchanger 62 will receive a stream of air blown over it and will heat the air by condensing the working fluid.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
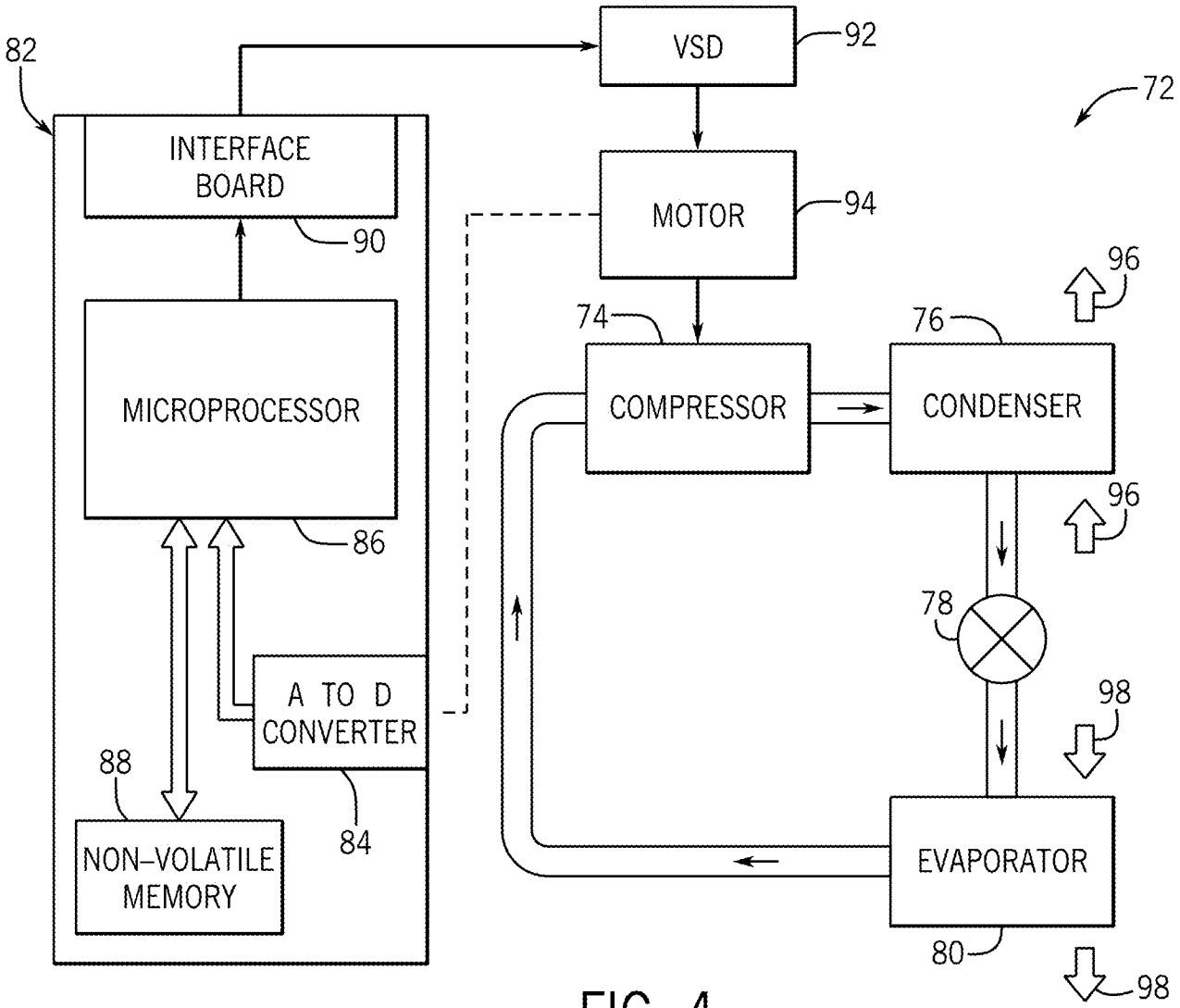
FIG. 4 is a schematic view of an embodiment of a vapor compression system that may be used in an HVAC system, in accordance with aspects of the present disclosure.

FIG. 4 is an embodiment of a vapor compression system 72 that can be used in any of the systems described above and incorporates one or more drainage system in accordance with present embodiments. The vapor compression system 72 may circulate a working fluid through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a working fluid vapor and delivers the vapor to the condenser 76 through a discharge passage. In some embodiments, the compressor 74 may be a centrifugal compressor. The working fluid vapor delivered by the compressor 74 to the condenser 76 may transfer heat to a fluid passing across the condenser 76, such as ambient or environmental air 96. The working fluid vapor may condense to a working fluid liquid in the condenser 76 as a result of thermal heat transfer with the environmental air 96. The liquid working fluid from the condenser 76 may flow through the expansion device 78 to the evaporator 80.

The liquid working fluid delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid working fluid in the evaporator 80 may undergo a phase change from the liquid working fluid to a working fluid vapor. In this manner, the evaporator 80 may reduce the temperature of the supply air stream 98 via thermal heat transfer with the working fluid. Thereafter, the vapor working fluid exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As discussed below, the system(s) and/or unit(s) described with respect to FIGS. 1-4 above may employ a refrigerant having a low global warming potential (GWP). For example, the refrigerant may be an A2L refrigerant, such as a non-toxic, hydrofluoroolefin (HFO) based refrigerant (e.g., R-454B), with relatively low (e.g., mild) flammability. For a variety of reasons, including but not limited to rules and regulations related to using the relatively low GWP refrigerant in the system(s) and/or unit(s) of FIGS. 1-4, a refrigerant sensor may be employed to detect a refrigerant leak, and a refrigerant leak mitigation control board assembly may be employed to perform one or more actions in response to receiving data indicative of the refrigerant leak from the refrigerant sensor. The refrigerant sensor and the refrigerant leak mitigation control board assembly may be selectively located in particular areas of the system(s) and/or unit(s) (e.g., on a delta plate of a heat exchanger of an indoor unit, on a blower housing corresponding to the indoor unit, on an inner casing surface corresponding to the indoor unit, etc.) to improve refrigerant leak detection (e.g., accuracy and/or consistency), reduce cost associated with refrigerant leak detection, improve compliance with rules and regulations, and/or reduce a footprint of the HVAC system relative to traditional configurations. These and other aspects of the present disclosure are described in detail below.

Figure 5:
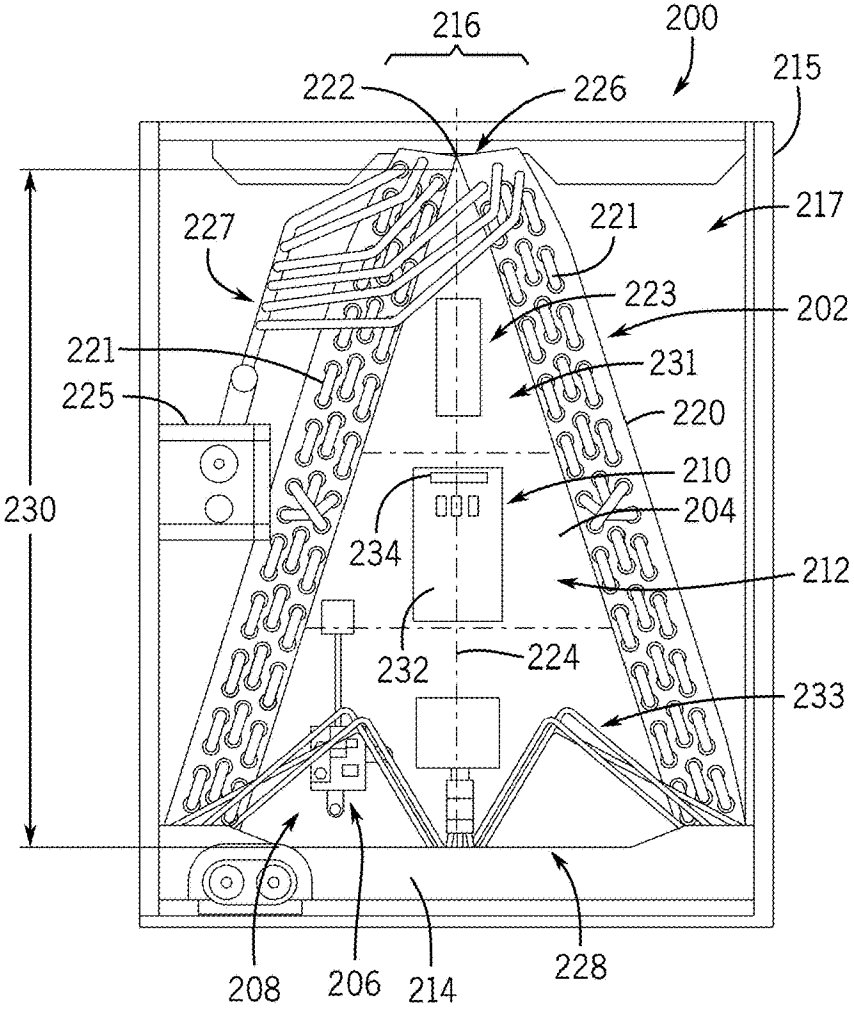
FIG. 5 is a cross-sectional front view of an embodiment of an HVAC unit (or portion thereof), such as an indoor unit, having a heat exchanger (e.g., tube-and-fin heat exchanger), a delta plate, a refrigerant sensor coupled to a corner of the delta plate, and a refrigerant leak mitigation control board assembly coupled to the delta plate and overlapping with a mid-section of the delta plate, in accordance with aspects of the present disclosure.

FIG. 5 is a cross-sectional front view of an embodiment of an HVAC unit 200 (or portion thereof), such as an indoor unit (or "air handler"), having a heat exchanger 202 (e.g., tube-and-fin heat exchanger), a delta plate 204, a refrigerant sensor 206 coupled to a corner 208 of the delta plate 204, and a refrigerant leak mitigation control board assembly 210 coupled to the delta plate 204 and overlapping with a mid-section 212 of the delta plate 204. As shown, the heat exchanger 202 (and other componentry of the HVAC unit 200) is disposed in a casing 215 of the HVAC unit 200 (e.g., in a casing interior 217 defined by the casing 215).

In general, the refrigerant sensor 206 is configured to detect a refrigerant leak associated with the HVAC unit 200 (e.g., a presence of refrigerant leaked from the heat exchanger 202, such as a presence and/or concentration of the leaked refrigerant in air), and the refrigerant leak mitigation control board assembly 210 is configured to receive from the refrigerant sensor 206 data indicative of the refrigerant leak. In some embodiments, the refrigerant sensor 206 and/or the refrigerant leak mitigation control board assembly 210 detect the refrigerant leak in response to an amount (e.g., concentration) of the refrigerant in air exceeding a threshold amount (e.g., threshold concentration), although other detection mechanisms are also possible. Further, the refrigerant leak mitigation control board assembly 210 may be configured to perform at least one action in response to determining (e.g., based on the data received from the refrigerant sensor 206) the refrigerant leak, such as transmitting an alert to an external device, adjusting operation of an aspect of the HVAC unit 200 (or an HVAC system in which the HVAC unit 200 is employed) to mitigate the refrigerant leak or an impact thereof, etc.

The position of the refrigerant sensor 206 (e.g., in the corner 208 of the delta plate 204) may improve refrigerant leak detection (e.g., accuracy and consistency), reduce cost associated with refrigerant leak detection, prevent interference (e.g., physical interference) of the refrigerant sensor 206 with other aspects of the HVAC unit 200, and/or reduce or minimize a contribution of the refrigerant sensor 206 to a footprint of the HVAC unit 200. For example, leaked refrigerant may tend to gather or accumulate toward a bottom of the HVAC unit 200, for example, adjacent to a drain pan 214 of the HVAC unit 200, where the drain pan 214 is configured to receive liquid condensate and drain the liquid condensate (e.g., via holes, conduits, etc.) from the HVAC unit 200. Accordingly, the illustrated location of the refrigerant sensor 206 may be desirable for detecting the leaked refrigerant, as the leaked refrigerant tends to gather or accumulate in this area, while remaining out of the way of other aspects of the HVAC unit 200. Likewise, the position of the refrigerant leak mitigation control board assembly 210 (e.g., in the mid-section 212 of the delta plate 204) may reduce cost associated with refrigerant leak detection, prevent interference (e.g., physical interference) of the refrigerant leak mitigation control board assembly 210 with other aspects of the HVAC unit 200, and/or reduce or minimize a contribution of the refrigerant leak mitigation control board assembly 210 to the footprint of the HVAC unit 200.

As shown, the heat exchanger 202 includes a V-shaped arrangement 216 (e.g., a V-shaped coil or coil assembly) formed by a first leg 218 and a second leg 220 that are coupled (and/or approach each other) at a vertex 222 of the V-shaped arrangement 216, where tubes 221 of the V-shaped arrangement 216 are distributed through the first leg 218 and the second leg 220, and an access panel 225 enables routing of the refrigerant through a manifold assembly 227 into the tubes 221 (or some other refrigerant conveying feature of the heat exchanger 202, such as microchannels). The delta plate 204 is coupled to (and/or integral with) the legs 218, 220 and may, for example, at least partially define an air flow 223 path between the legs 218, 220. A shape of the delta plate 204 may be bound by the legs 218, 220 of the V-shaped arrangement 216. That is, in some embodiments, the delta plate 204 does not extend beyond (or substantially beyond) the legs 218, 220 of the V-shaped arrangement 216. Accordingly, in some embodiments, the delta plate 204 may include or approximate a triangular shape. Further, in some embodiments, an additional instance of the delta plate 204 may be employed on an opposing side of the legs 218, 220 of the V-shaped arrangement 216.

A central axis 224 (e.g., corresponding to the delta plate 204) extends from a first end 226 (e.g., top end) of the delta plate 204 (e.g., adjacent the vertex 222) to a second end 228 (e.g., bottom end) of the delta plate 204. The central axis 224 may run, for example, along a height 230 of the delta plate 204, and/or extend at a substantially right angle (e.g., within 3 degrees) to the first end 226 of the delta plate 204, the second end 228 of the delta plate 204, or both. Further, the delta plate 204 includes a first section (referred to below as an upper section 231), a second section (referred to below as a lower section 233), and the mid-section 212 between the upper section 231 and the lower section 233. The upper section 231, the mid-section 212, and the lower section 233 each may constitute approximately one third of the height 230 of the delta plate 204 in certain embodiments. The corner 208 in which the refrigerant sensor 206 is disposed resides in the lower section 233 and to a side of the central axis 224. In this way, the refrigerant sensor 206 may be coupled to the delta plate 204 at a position closer to the second end 228 of the delta plate 204 than the first end 226 of the delta plate 204. Further, as shown, the central axis 224 does not overlap with the refrigerant sensor 206 in the illustrated embodiment. That is, the refrigerant sensor 206 is offset from the central axis 224 within the corner 208 of the delta plate 204. The refrigerant leak mitigation control board assembly 210 overlaps with the central axis 224 and is disposed at least in part in the mid-section 212 of the delta plate 204.

As shown, the refrigerant leak mitigation control board assembly 210 includes a board 232 (e.g., a printed circuit board) and circuitry 234 (e.g., processing circuitry, memory circuitry, and/or communication circuitry) disposed on the board 232. It should be noted that the refrigerant leak mitigation control board assembly 210 may include other componentry in certain embodiments, such as an enclosure, a mounting plate, fastening components, etc. The board 232 and the circuitry 234 illustrated in FIG. 5 are merely examples of componentry included in the refrigerant leak mitigation control board assembly 210, and do not limit other possible componentry of the refrigerant leak mitigation control board assembly 210.

Figure 6:
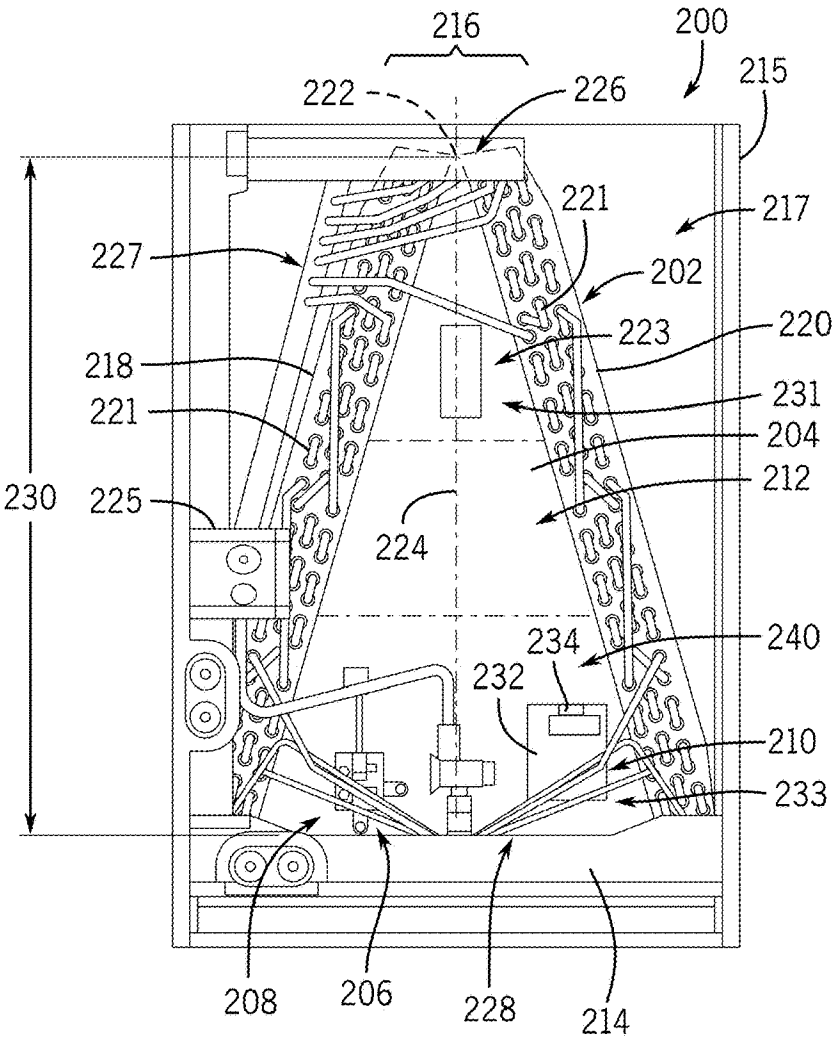
FIG. 6 is a cross-sectional front view of an embodiment of an HVAC unit (or portion thereof), such as an indoor unit, having a heat exchanger (e.g., tube-and-fin heat exchanger), a delta plate, a refrigerant sensor coupled to a corner of the delta plate, and a refrigerant leak mitigation control board assembly coupled to an opposing corner of the delta plate, in accordance with aspects of the present disclosure.

Other locations of the refrigerant leak mitigation control board assembly 210 are also possible. For example, FIG. 6 is a cross-sectional front view of an embodiment of the HVAC unit 200 (or portion thereof), such as an indoor unit, having the heat exchanger 202 (e.g., tube-and-fin heat exchanger), the delta plate 204, the refrigerant sensor 206 coupled to the corner 208 of the delta plate 204, and the refrigerant leak mitigation control board assembly 210. Unlike in FIG. 5, in FIG. 6, the refrigerant leak mitigation control board assembly 210 is coupled to an additional corner 240 of the delta plate 204, where the additional corner 240 opposes the corner 208, and both the corner 208 and the additional corner 240 reside in the lower section 233 of the delta plate 204.

Figure 7:
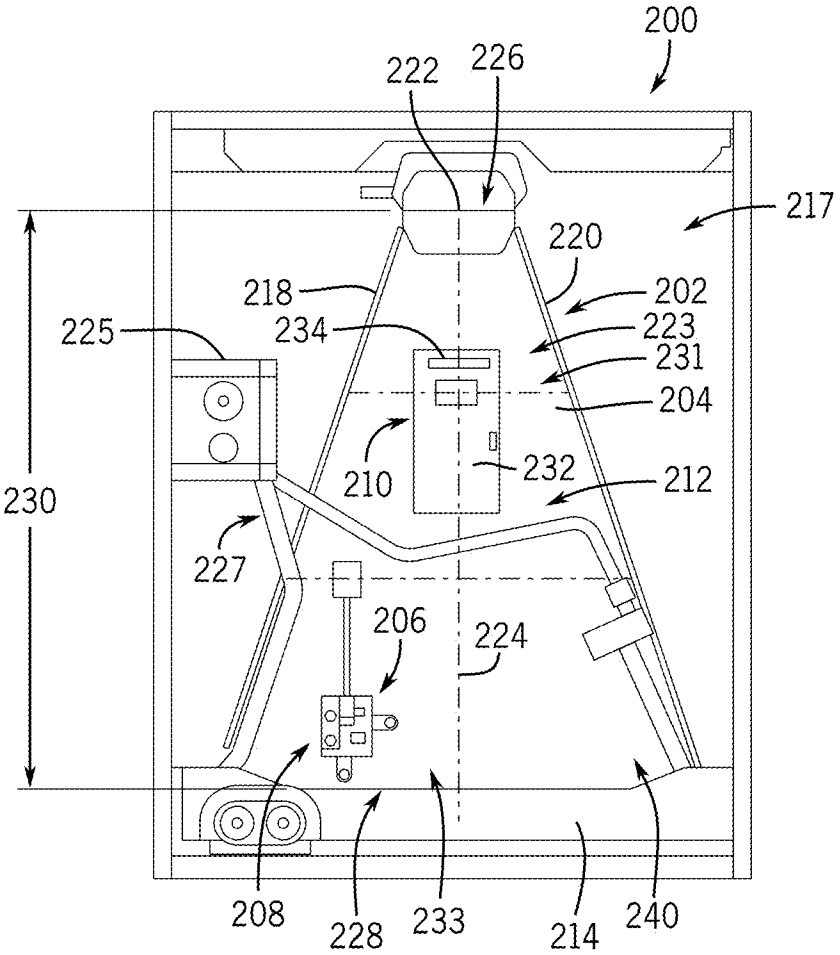
FIG. 7 is a cross-sectional front view of an embodiment of an HVAC unit (or portion thereof), such as an indoor unit, having a heat exchanger (e.g., microchannel heat exchanger), a delta plate, a refrigerant sensor coupled to a corner of the delta plate, and a refrigerant leak mitigation control board assembly coupled to the delta plate and overlapping with a mid-section and/or upper section of the delta plate, in accordance with aspects of the present disclosure.

Still other locations of the refrigerant leak mitigation control board assembly 210 are also possible. FIG. 7 is a cross-sectional front view of an embodiment of the HVAC unit 200 (or portion thereof), such as an indoor unit, having the heat exchanger 202 (e.g., microchannel heat exchanger), the delta plate 204, the refrigerant sensor 206 coupled to the corner 208 of the delta plate 204, and the refrigerant leak mitigation control board assembly 210 coupled to the delta plate 204 and overlapping with the mid-section 212 and/or the upper section 231 of the delta plate 204. The heat exchanger 202 in FIG. 7 can be distinguished from the heat exchanger 202 of FIGS. 5 and 6 in that the heat exchanger 202 in FIG. 7 is a microchannel heat exchanger, whereas the heat exchanger 202 in FIGS. 5 and 6 is a tube-and-fin heat exchanger. However, the heat exchanger 202 in FIG. 7 may still include the V-shaped arrangement 216 formed by the first leg 218 and the second leg 220, except that the first leg 218 and the second leg 220 in FIG. 7 may include microchannels configured to receive the refrigerant instead of tubes configured to receive the refrigerant. As shown in FIG. 7, the refrigerant leak mitigation control board assembly 210 may be coupled to the delta plate 204 at a position overlapping with the mid-section 212 of the delta plate 204 and the upper section 231 of the delta plate 204. In other embodiments, the refrigerant leak mitigation control board assembly 210 may reside entirely within the upper section 231 of the delta plate 204.

Figure 8:
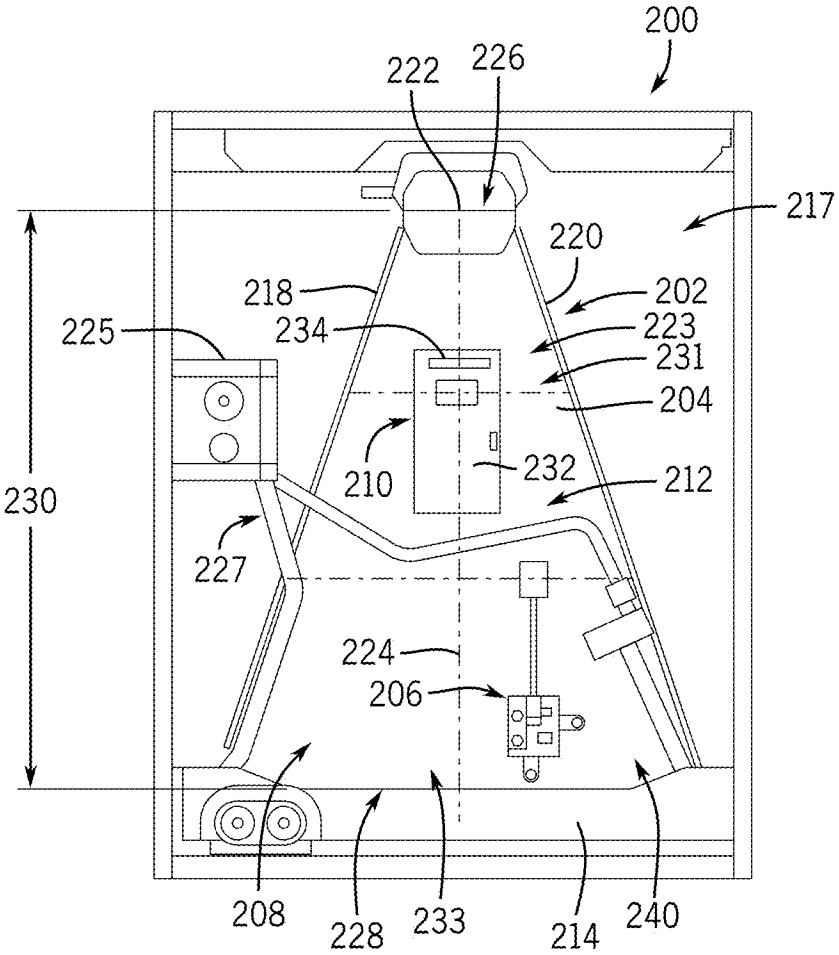
FIG. 8 is a cross-sectional front view of an embodiment of an HVAC unit (or portion thereof), such as an indoor unit, having a heat exchanger (e.g., microchannel heat exchanger), a delta plate, a refrigerant sensor coupled to a corner of the delta plate, and a refrigerant leak mitigation control board assembly coupled to the delta plate and overlapping with a mid-section and/or an upper section of the delta plate, in accordance with aspects of the present disclosure.

FIG. 8 is a cross-sectional front view of an embodiment of the HVAC unit 200 (or portion thereof), such as an indoor unit, having the heat exchanger 202 (e.g., microchannel heat exchanger), the delta plate 204, the refrigerant sensor 206 coupled to additional corner 240 of the delta plate 204, and the refrigerant leak mitigation control board assembly 210 coupled to the delta plate 204 and overlapping with the mid-section 212 and/or the upper section 231 of the delta plate 204. That is, the refrigerant sensor 206 in FIG. 7 is coupled to the corner 208 of the delta plate 204, whereas the refrigerant sensor 206 in FIG. 8 is coupled to the additional corner 240 of the delta plate 204, the additional corner 240 opposing the corner 208. The locations of the refrigerant sensor 206 and/or the refrigerant leak mitigation control board assembly 210 in FIGS. 7 and 8 may improve refrigerant leak detection (e.g., accuracy and consistency), reduce cost associated with refrigerant leak detection, improve compliance with rules and regulations regarding refrigerant leak detection (or the use of certain types of refrigerants in the HVAC unit 200), and/or reduce or minimize a footprint of the HVAC unit 200 attributable to refrigerant leak detection componentry.

Figure 10:
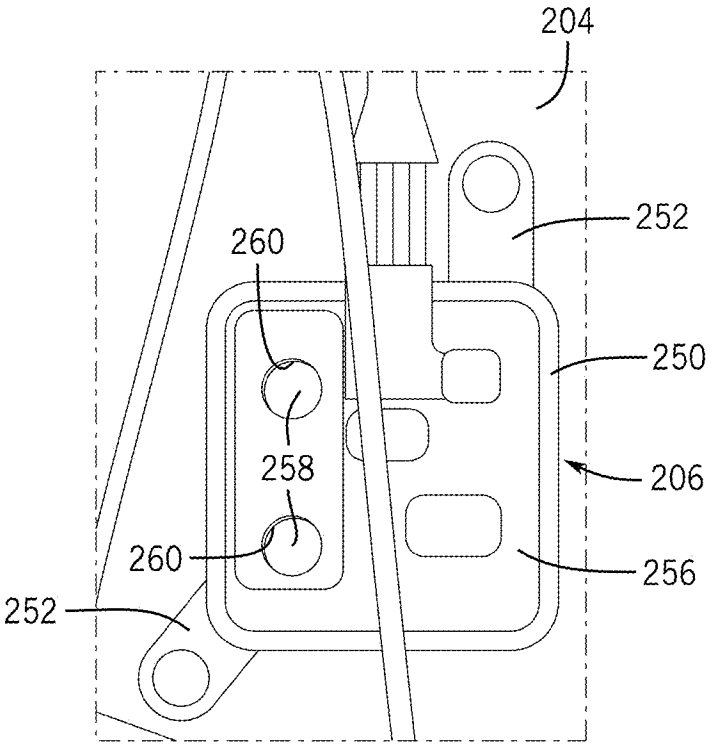
FIG. 10 is a front view of an embodiment of a refrigerant sensor for an HVAC unit, such as an indoor unit, in accordance with aspects of the present disclosure.
Figure 9:
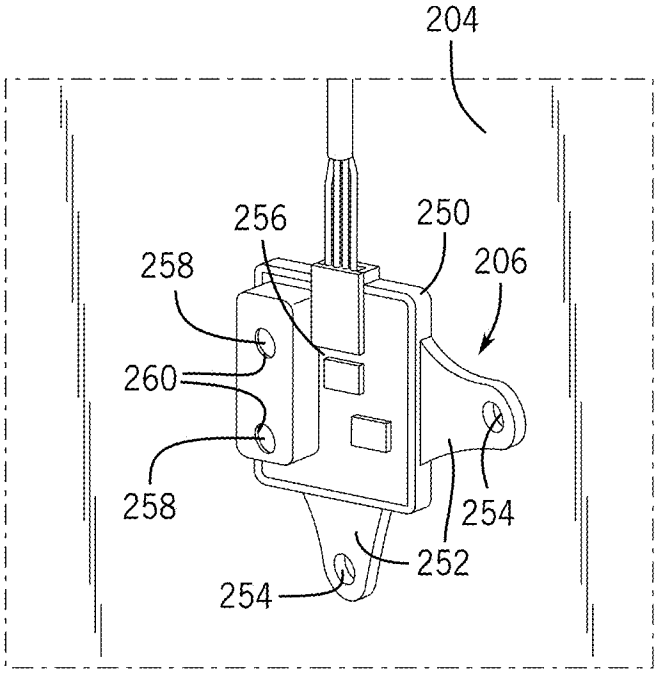
FIG. 9 is a perspective view of an embodiment of a refrigerant sensor for an HVAC unit, such as an indoor unit, in accordance with aspects of the present disclosure.

FIG. 9 is a perspective view of an embodiment of the refrigerant sensor 206 for the HVAC unit 200, such as an indoor unit. Further, FIG. 10 is a front view of an embodiment of the refrigerant sensor 206 for the HVAC unit 200, such as an indoor unit. As shown in FIGS. 9 and 10, the refrigerant sensor 206 is coupled to (e.g., mounted on) the delta plate 204. The refrigerant sensor 206 in FIGS. 9 and 10 includes a mounting bracket 250 with mounting tabs 252 (e.g., extensions) having holes 254 therein, the holes 254 being configured to receive fasteners that extend into corresponding holes of the delta plate 204. In some embodiments, other mechanisms (e.g., adhesives, welding, etc.) may be employed for coupling the refrigerant sensor 206 to the delta plate 204. A lid 256 may be coupled to (e.g., snap-fit to) the mounting bracket 250 to form a cavity configured to receive one or more sensing elements 258 of the refrigerant sensor 206 in certain embodiments, where the one or more sensing elements 258 are exposed to environment via one or more holes 260 in the lid 256. FIGS. 9 and 10 are merely examples of the refrigerant sensor 206 and other arrangements are also possible.

Figure 11:
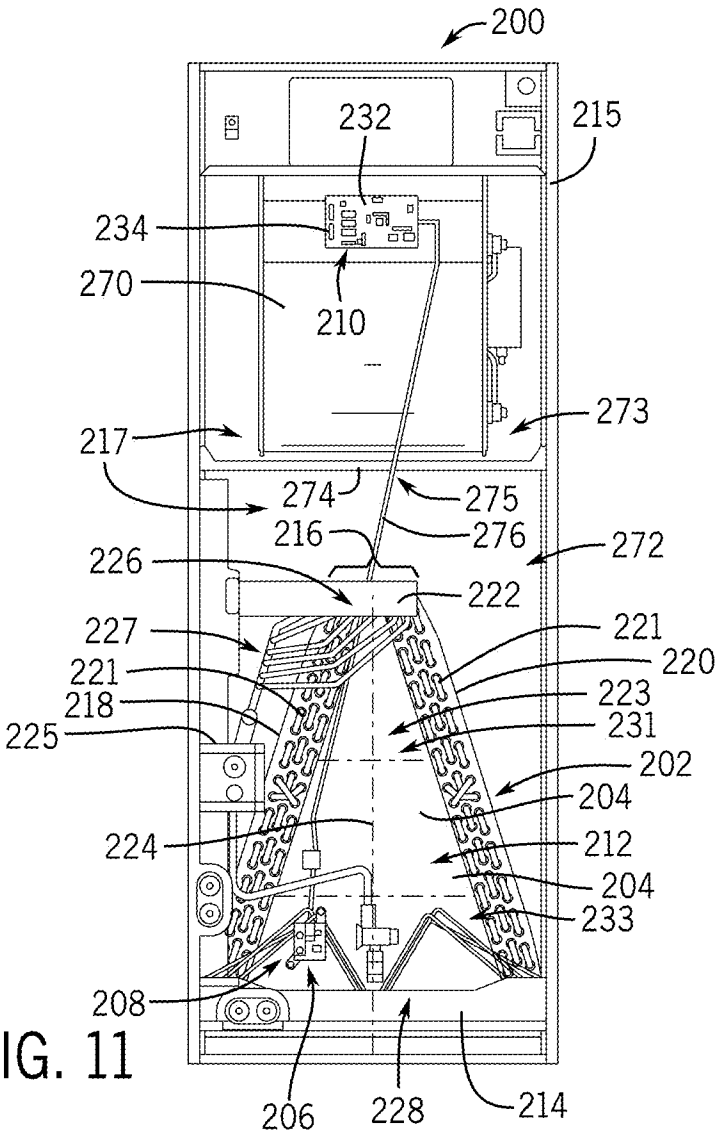
FIG. 11 is a cross-sectional front view of an embodiment of an HVAC unit (or portion thereof), such as an indoor unit, having a heat exchanger (e.g., tub-and-fin heat exchanger), a delta plate, a refrigerant sensor coupled to a corner of the delta plate, a blower housing of a blower, and a refrigerant leak mitigation control board assembly coupled to the blower housing, in accordance with aspects of the present disclosure.

FIG. 11 is a cross-sectional front view of an embodiment of the HVAC unit 200 (or portion thereof), such as an indoor unit, having the heat exchanger 202 (e.g., tub-and-fin heat exchanger), the delta plate 204, the refrigerant sensor 206 coupled to the corner 208 of the delta plate 204, a blower housing 270 of a blower, and the refrigerant leak mitigation control board assembly 210 coupled to the blower housing 270. The illustrated location of the refrigerant leak mitigation control board assembly 210 at the blower housing 270 may be beneficial in embodiments where the heat exchanger 202 is not sized to accommodate attachment of the refrigerant leak mitigation control board assembly 210 to the delta plate 204 without substantially increasing a footprint of the HVAC unit 202. Additionally or alternatively, the illustrated location of the refrigerant leak mitigation control board assembly 210 may improve accessibility to the refrigerant leak mitigation control board assembly 210 (and/or reduce cost) for servicing, maintenance, diagnostics, etc.

As shown, the casing 215 of the HVAC unit 200 defines a heat exchanger compartment 272 of the casing interior 217 and a blower compartment 273 of the casing interior 217, where the heat exchanger 202 is disposed in the heat exchanger compartment 272 and the blower housing 270 (and blower inside the blower housing 270) is disposed in the blower compartment 273. A separating wall 274 may at least partially separate the heat exchanger compartment 272 from the blower compartment 273. In some embodiments, an opening 275 through the separating wall 274 facilitates a wired connection 276 (e.g., communication wire, communication cable, etc.) between the refrigerant sensor 206 coupled to the delta plate 204 and the refrigerant leak mitigation control board assembly 210 coupled to the blower housing 270 (although wireless communicatively coupling is also possible). Additional details regarding the refrigerant leak mitigation control board assembly 210 coupled to the blower housing 270 are provided below with reference to later drawings.

Figure 12:
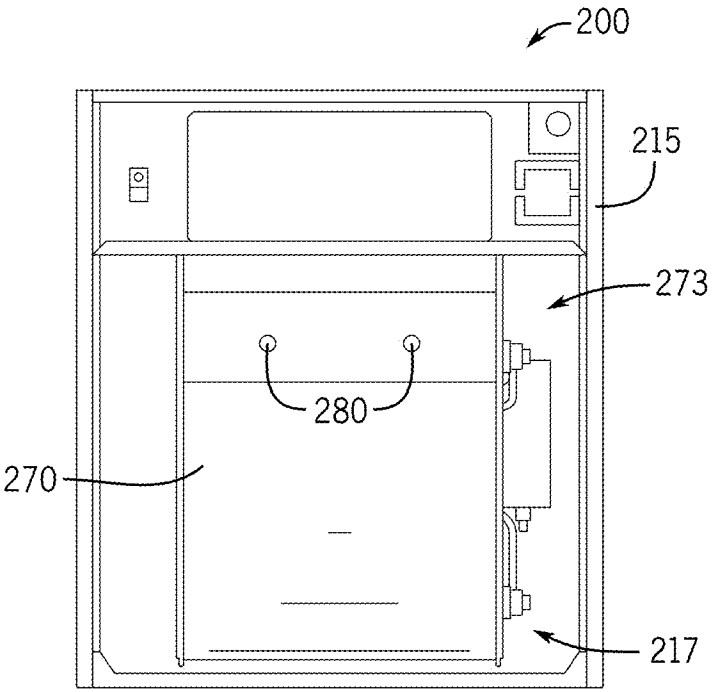
FIG. 12 is a cross-sectional front view of an embodiment of a blower housing of a blower for an HVAC unit, such as an indoor unit, with holes configured to facilitate a coupling of a refrigerant leak mitigation control board assembly with the blower housing, in accordance with aspects of the present disclosure.
Figure 13:
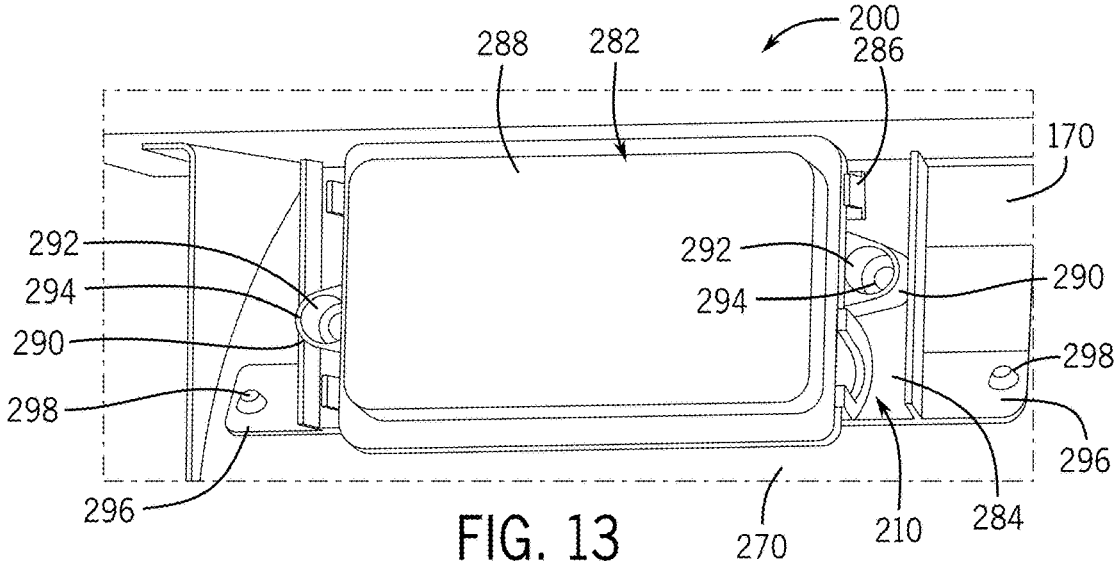
FIG. 13 is a perspective front view of an embodiment of a refrigerant leak mitigation control board assembly coupled (e.g., via an enclosure and mounting plate) to a blower housing of an HVAC unit, such as an indoor unit, in accordance with aspects of the present disclosure.

For example, FIG. 12 is a cross-sectional front view of an embodiment of the blower housing 270 of the blower for an HVAC unit 200, such as an indoor unit, with holes 280 configured to facilitate a coupling of the refrigerant leak mitigation control board assembly 210 with the blower housing 270. Further, FIG. 13 is a perspective front view of an embodiment of the refrigerant leak mitigation control board assembly 210 coupled (e.g., via an enclosure 282 and mounting plate 284) to the blower housing 270 of the HVAC unit 200 (e.g., by way of fasteners through the openings 280 illustrated in FIG. 12). As shown, the refrigerant leak mitigation control board assembly 210 includes the enclosure 282, where the enclosure 282 includes a body 286 and a lid 288 coupled to the body 286. The body 286 includes tabs 290 (e.g., extensions) having holes 292 formed therein. Fasteners 294 are configured to extend through the holes 292 in the tabs 290 of the body 286, and through the mounting plate 284, to couple the enclosure 282 to the mounting plate 284. The mounting plate 284 also includes tabs 296 (e.g., extensions) in the illustrated embodiment, where additional fasteners 298 extend through holes in the tabs 296 to couple the mounting plate 284 to the blower housing 270. For example, the additional fasteners 298 extending through the tabs 296 in the mounting plate 284 may also extend through the holes 280 illustrated in the blower housing 270 in FIG. 12.

Figure 14:
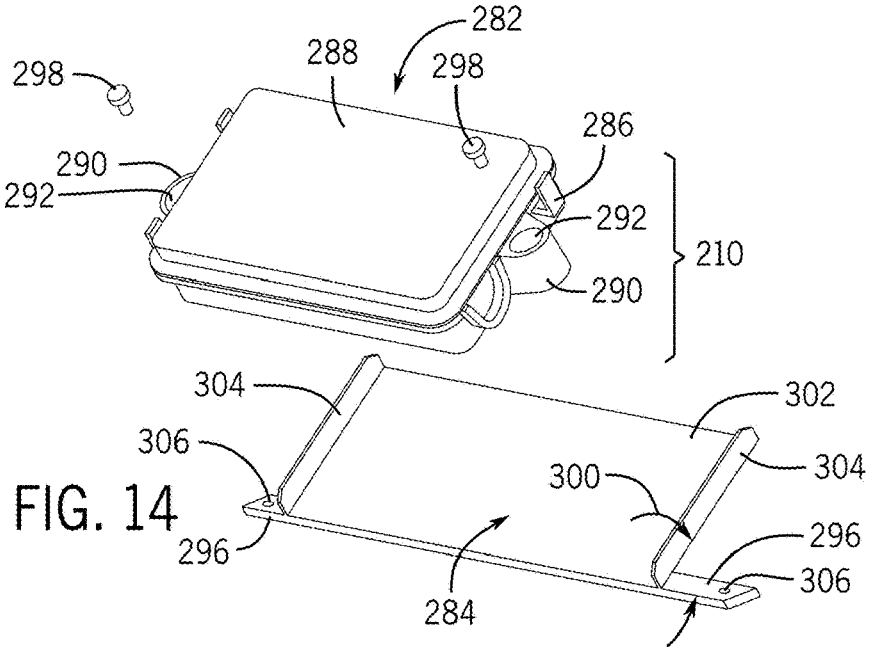
FIG. 14 is an exploded perspective view of an embodiment of a refrigerant leak mitigation control board assembly including an enclosure and a mounting plate, where the mounting plate is configured to be coupled to a blower housing of an HVAC unit, such as an indoor unit, in accordance with aspects of the present disclosure.

In some embodiments, the mounting plate 284 includes angular features configured to angle a portion of the refrigerant leak mitigation control board assembly 210 relative to a curvature of the blower housing 270, which may improve accessibility of the refrigerant leak mitigation control board assembly 210 during maintenance, installation, and/or diagnostic procedures. For example, FIG. 14 is an exploded perspective view of an embodiment of the refrigerant leak mitigation control board assembly 210 including the enclosure 282 and the mounting plate 284 configured to be coupled to a blower housing. As shown, the tabs 296 of the mounting plate 284 may extend at an angle 300 (e.g., an acute angle) relative to a receiving wall 302 of the mounting plate 284. That is, the receiving wall 302 may be configured to receive the enclosure 282 (e.g., between guides 304 extending from the receiving wall 302), and the tabs 296 may form the angle 300 (e.g., acute angle) relative to the receiving wall 302. Holes 306 in the tabs 296 are configured to receive the additional fasteners 298, as previously described.

Figure 15:
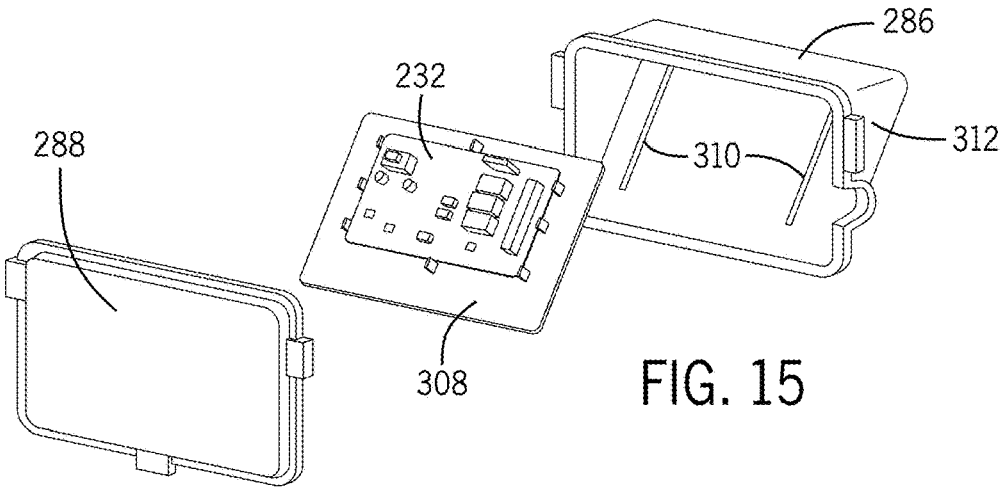
FIG. 15 is an exploded perspective view of an embodiment of a refrigerant leak mitigation control board assembly including an enclosure, where the enclosure is configured to be coupled (e.g., via a mounting plate) to a blower housing of an HVAC unit, such as an indoor unit, in accordance with aspects of the present disclosure.

FIG. 15 is an exploded perspective view of an embodiment of the refrigerant leak mitigation control board assembly 210 including the enclosure 282 configured to be coupled to a blower housing, where the board 232 (e.g., printed circuit board) is disposed in the enclosure 282. In some embodiments, the board 232 is coupled to a support 308 (e.g., a substrate), where the support 308 is received by ridges 310 in the body 286 of the enclosure 282 to maintain a position of the board 232 therein. In the embodiment illustrated in FIG. 15, the body 286 of the enclosure 282 is configured to be coupled to the blower housing directly (e.g., without a separate mounting plate). For example, the body 286 may include a triangular profile or shape 312 that enables a similar angling of the refrigerant leak mitigation control board assembly 210 (e.g., with respect to a curvature of a blower housing) as described above with respect to FIGS. 13 and 14.

Figure 16:
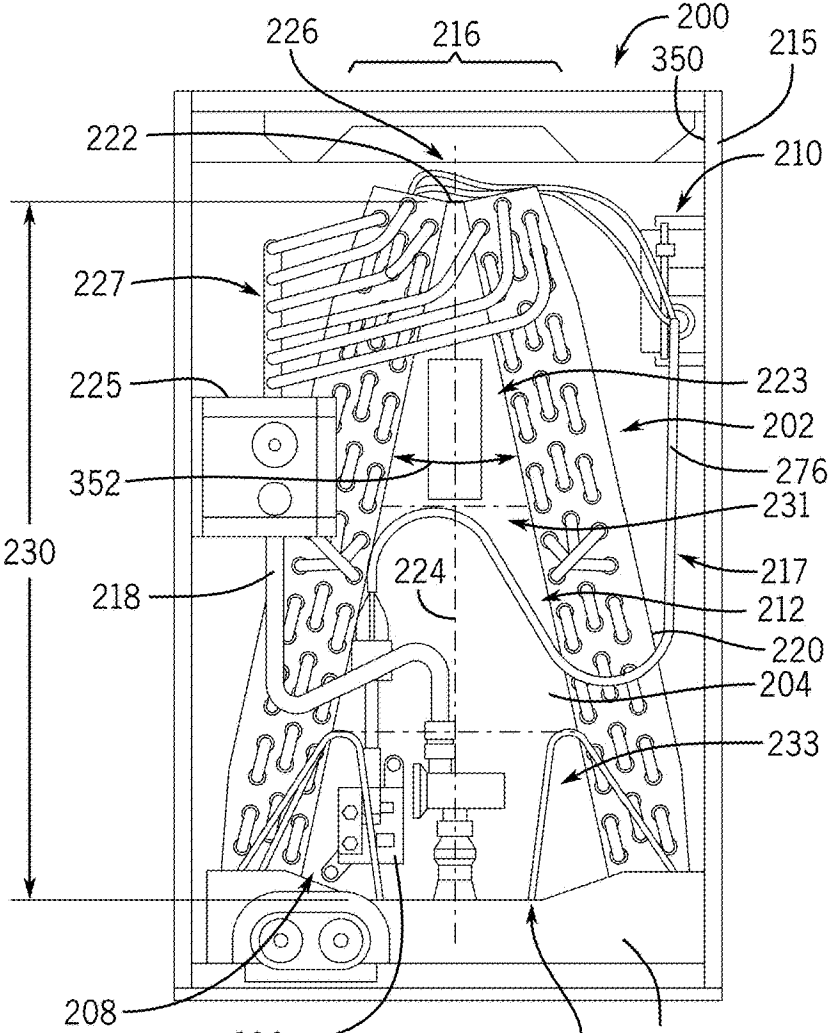
FIG. 16 is a cross-sectional front view of an embodiment of an HVAC unit (or portion thereof), such as an indoor unit, having a heat exchanger (e.g., tube-and-fin heat exchanger), a delta plate, a refrigerant sensor coupled to a corner of the delta plate, and a refrigerant leak mitigation control board assembly coupled to an inner casing surface of a casing of the HVAC unit, in accordance with aspects of the present disclosure.

FIG. 16 is a cross-sectional front view of an embodiment of an HVAC unit 200 (or portion thereof), such as an indoor unit, having the heat exchanger 202 (e.g., tube-and-fin heat exchanger), the delta plate 204, the refrigerant sensor 206 coupled to the corner 208 of the delta plate 204, and the refrigerant leak mitigation control board assembly 210 coupled to an inner casing surface 350 of the casing 215 of the HVAC unit 200. The illustrated location of the refrigerant leak mitigation control board assembly 10 coupled to the inner casing surface 350 may be particularly beneficial in embodiments in which the first leg 218 and the second leg 220 of the V-shaped arrangement 216 form an angle 352 that is relatively small (e.g., between 10 degrees and 45 degrees), as the angle 352 being relatively small reduces a size of the delta plate 204 and corresponding area in which the refrigerant leak mitigation control board assembly 210 could be disposed.

Figure 17:
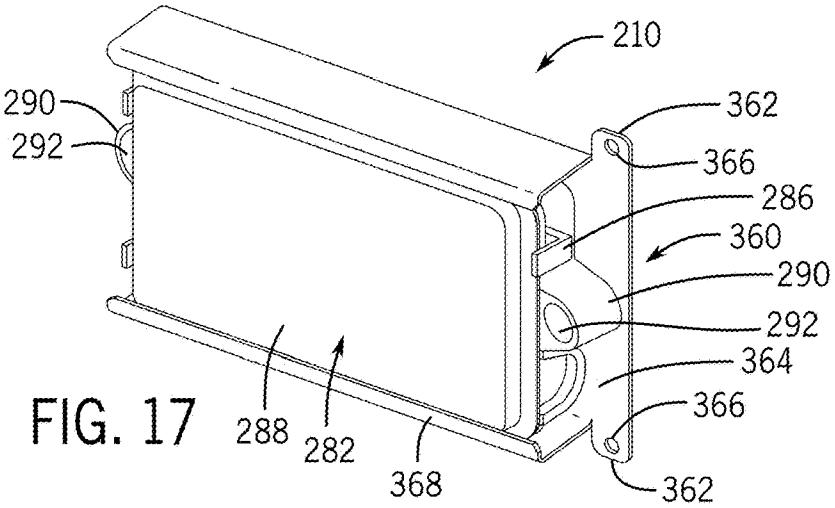
FIG. 17 is a perspective view of an embodiment of a refrigerant leak mitigation control board assembly having an enclosure and a mounting plate, where the mounting plate is configured to be coupled to an inner casing surface of a casing of an HVAC unit, such as an indoor unit, in accordance with aspects of the present disclosure.
Figure 18:
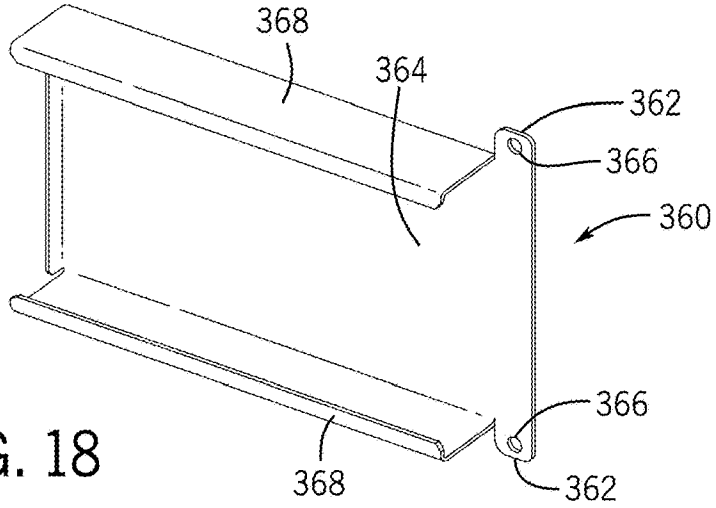
FIG. 18 is a perspective view of an embodiment of a mounting plate of a refrigerant leak mitigation control board assembly, where the mounting plate is configured to be coupled to an inner casing surface of a casing of an HVAC unit, such as an indoor unit, in accordance with aspects of the present disclosure.

FIG. 17 is a perspective view of an embodiment of the refrigerant leak mitigation control board assembly 210 for coupling to the inner casing surface 250 as illustrated in FIG. 16, and FIG. 18 is a perspective view of an embodiment of a mounting plate of the refrigerant leak mitigation control board assembly 210 for coupling to the inner casing surface 250 as illustrated in FIG. 16. The refrigerant leak mitigation control board assembly 210 of FIG. 17 may include certain features similar to those illustrated in FIGS. 13 and 14, such as the body 288 (and corresponding features) of the enclosure 282 and the lid 288 (and corresponding features) of the enclosure 282. However, a mounting plate 360, illustrated in FIGS. 17 and 18, may differ from the mounting plate 284 illustrated in FIGS. 13 and 14. For example, the mounting plate 360 in FIGS. 17 and 18 may not include the same angular features illustrated in the mounting plate 284 of FIGS. 13 and 14, since the inner casing surface 250 to which the mounting plate 360 is configured to be coupled may be substantially flat. The mounting plate 360 in FIGS. 17 and 18 includes tabs 362 (e.g., extensions) extending at substantially right angles from a receiving surface 364 configured to receive the enclosure 282, where holes 366 in the tabs 362 are configured to receive fasteners that extend into the inner casing wall 350 illustrated in FIG. 16. Further, the mounting plate 360 illustrated in FIGS. 17 and 18 includes channel guides 368 configured to retain a position of the enclosure 282 relative to the mounting plate 360. In some embodiments, the enclosure 282 is fastened, welded to, adhered, or otherwise coupled with the mounting plate 360.

Figure 21:
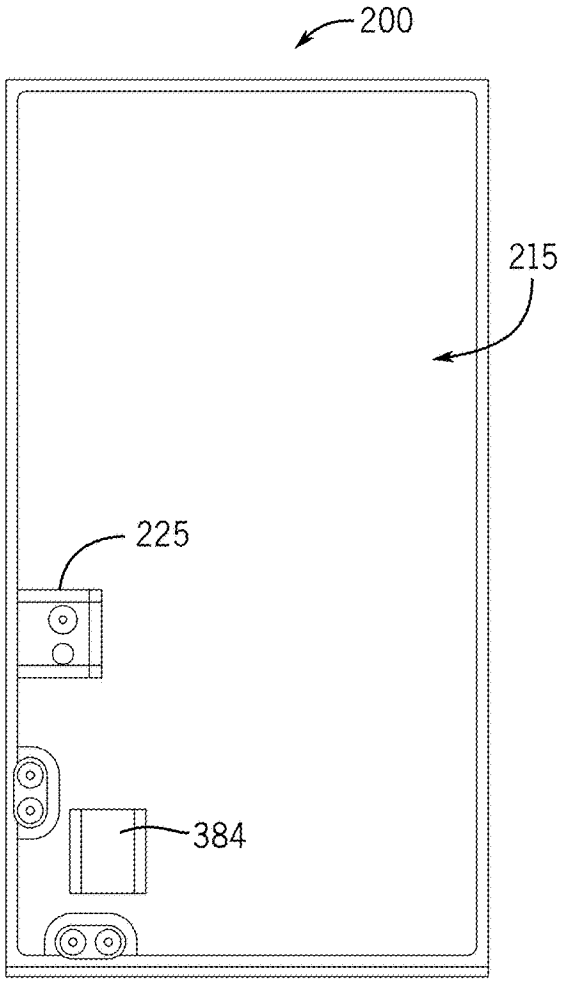
FIG. 21 is a front view of an embodiment of a mounting plate for a casing-mounted refrigerant leak mitigation control board assembly of an HVAC unit (or portion thereof), such as an indoor unit, in accordance with aspects of the present disclosure.
Figure 20:
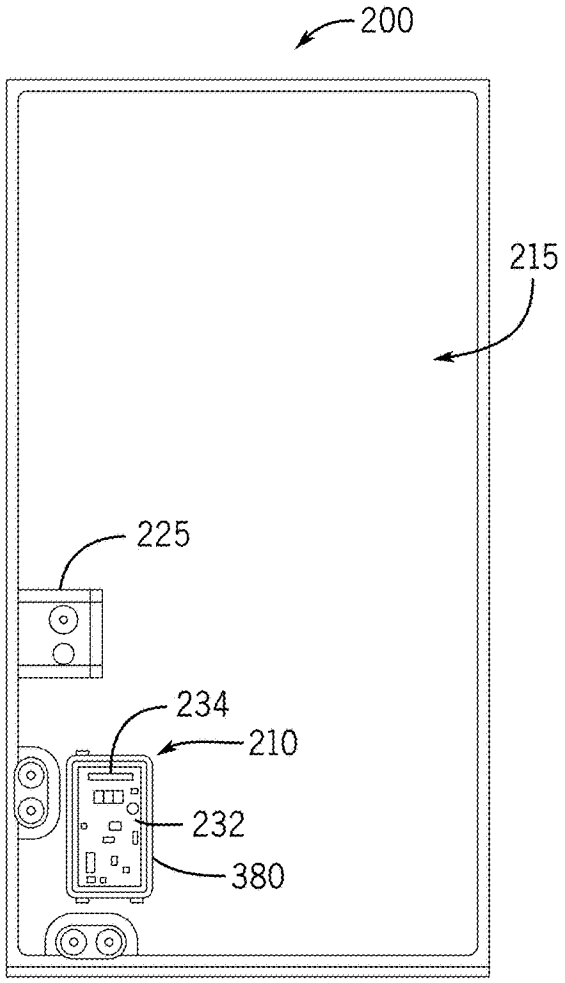
FIG. 20 is a front view of an embodiment of casing-mounted refrigerant leak mitigation control board assembly of an HVAC unit (or portion thereof), such as an indoor unit, including a portion of an enclosure of the casing-mounted refrigerant leak mitigation control board assembly, in accordance with aspects of the present disclosure.
Figure 19:
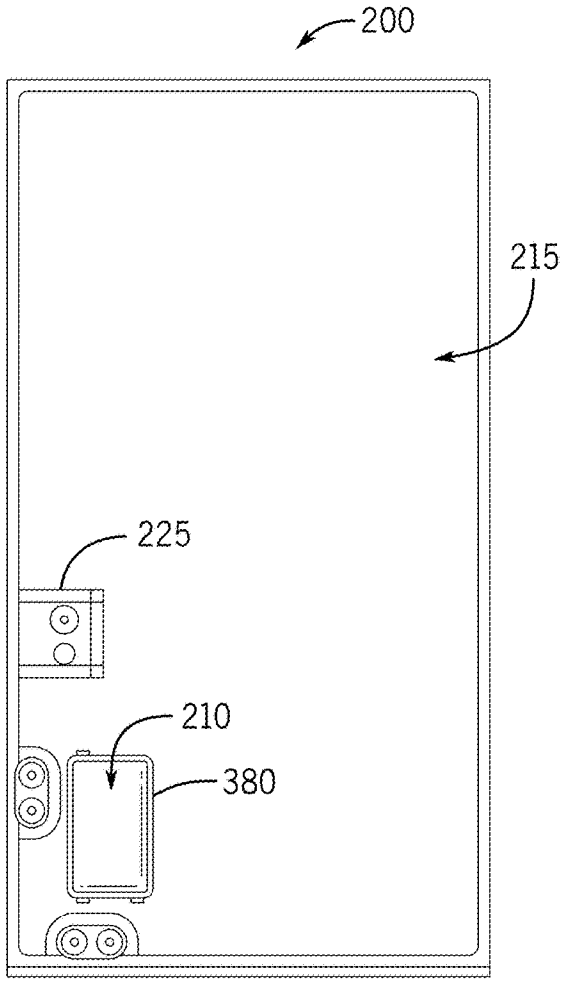
FIG. 19 is a front view of an embodiment of casing-mounted refrigerant leak mitigation control board assembly of an HVAC unit (or portion thereof), such as an indoor unit, including an enclosure of the casing-mounted refrigerant leak mitigation control board assembly, in accordance with aspects of the present disclosure.

FIGS. 19-21 include various views and features of a casing-mounted refrigerant leak mitigation control board assembly 210 (e.g., mountable to an inner casing surface or outer casing surface of the casing 215 of the HVAC unit 200). For example, FIG. 19 is a front view of an embodiment of the refrigerant leak mitigation control board assembly 210, including an enclosure 380 of the refrigerant leak mitigation control board assembly 210. FIG. 20 is a front view of an embodiment of refrigerant leak mitigation control board assembly 210, including a portion of the enclosure 360 of the casing-mounted refrigerant leak mitigation control board assembly 210 (e.g., with a lid thereof removed to illustrate the board 232 and circuitry 234 on the board 232). FIG. 21 is a front view of an embodiment of a mounting plate 384 for receiving the enclosure 380 of the refrigerant leak mitigation control board assembly 210. Other locations of the refrigerant leak mitigation control board assembly 210 are also possible in accordance with the present disclosure, as described with reference to earlier drawings.

Embodiments of the present disclosure may provide one or more technical effects or benefits useful in the operation of an HVAC system. In particular, presently disclosed embodiments enable improved refrigerant leak detection, reduced cost associated with refrigerant leak detection, reduced footprint of the HVAC system, and/or improved compliance with rules and regulations regarding use of certain types of refrigerant (e.g., relative to traditional configurations).

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, and/or air conditioning (HVAC) unit, the HVAC unit comprising:
- a casing;
- a heat exchanger disposed in the casing and comprising a V-shaped arrangement having a first leg and a second leg;
- a delta plate extending from the first leg to the second leg; and
- a refrigerant sensor configured to detect a refrigerant leak associated with the HVAC unit, wherein the refrigerant sensor is coupled to the delta plate.

2. The HVAC unit of claim 1, wherein the first leg and the second leg form a vertex of the V-shaped arrangement adjacent to a first end of the delta plate, a drain pan of the HVAC unit is disposed adjacent to a second end of the delta plate opposing the first end, and the refrigerant sensor is coupled to the delta plate at a position closer to the second end than the first end.

3. The HVAC unit of claim 2, comprising a central axis extending across the delta plate from the vertex to the second end of the delta plate and forming a substantially right angle with the second end of the delta plate, wherein the central axis does not overlap with the refrigerant sensor.

4. The HVAC unit of claim 1, comprising a refrigerant leak mitigation control board assembly coupled to the delta plate and configured to receive data indicative of the refrigerant leak from the refrigerant sensor.

5. The HVAC unit of claim 4, wherein the first leg and the second leg form a vertex of the V-shaped arrangement adjacent to a first end of the delta plate, a drain pan of the HVAC unit is disposed adjacent to a second end of the delta plate opposing the first end, and the refrigerant leak mitigation control board assembly is coupled to the delta plate at a position closer to the first end than the second end.

6. The HVAC unit of claim 1, comprising a refrigerant leak mitigation control board assembly coupled to the casing or a blower housing of the HVAC unit and configured to receive data indicative of the refrigerant leak from the refrigerant sensor.

7. The HVAC unit of claim 1, wherein the HVAC unit is an indoor unit.

8. A heating, ventilation, and/or air conditioning (HVAC) unit, the HVAC unit comprising:
- a casing defining a casing interior;
- a blower housing disposed in the casing interior and configured to receive a blower;
- a heat exchanger disposed in the casing interior and comprising a V-shaped arrangement having a first leg and a second leg;
- a delta plate extending from the first leg to the second leg;
- a refrigerant leak mitigation control board assembly disposed in the casing interior and coupled to the delta plate, the casing, or the blower housing; and
- a refrigerant sensor configured to detect a refrigerant leak associated with the HVAC unit, wherein the refrigerant leak mitigation control board assembly is configured to receive data indicative of the refrigerant leak from the refrigerant sensor, and the refrigerant sensor is coupled to the delta plate.

9. The HVAC unit of claim 8, comprising a blower compartment within the casing interior, wherein the heat exchanger is disposed in a heat exchange compartment of the casing interior, and a wall at least partially separates the blower compartment from the heat exchange compartment.

10. The HVAC unit of claim 8, wherein the first leg and the second leg form a vertex of the V-shaped arrangement adjacent to a first end of the delta plate, a drain pan of the HVAC unit is disposed adjacent to a second end of the delta plate opposing the first end, and the refrigerant sensor is coupled to the delta plate at a position closer to the second end than the first end.

11. The HVAC unit of claim 10, comprising a central axis extending across the delta plate from the vertex to the second end of the delta plate and forming a substantially right angle with the second end of the delta plate, wherein the central axis does not overlap with the refrigerant sensor.

12. The HVAC unit of claim 11, wherein the refrigerant leak mitigation control board assembly is coupled to the delta plate at an additional position, and the central axis overlaps with the refrigerant leak mitigation control board assembly.

13. The HVAC unit of claim 8, wherein the HVAC unit is an indoor unit.

14. A heat exchanger of an indoor unit, the heat exchanger comprising:

a V-shaped heat exchanger having a first leg and a second leg;

a delta plate extending from the first leg to the second leg;

a refrigerant sensor coupled to the delta plate and configured to detect a refrigerant leak; and a refrigerant leak mitigation control board assembly configured to receive data indicative of the refrigerant leak from the refrigerant sensor.

15. The heat exchanger of claim 14, wherein the refrigerant leak mitigation control board assembly is coupled to the delta plate.

16. The heat exchanger of claim 15, wherein the first leg and the second leg form a vertex of the V-shaped heat exchanger adjacent to a first end of the delta plate, and the refrigerant sensor is coupled to the delta plate at a position further from the first end of the delta plate than a second end of the delta plate opposing the first end.

17. The heat exchanger of claim 16, wherein the refrigerant leak mitigation control board assembly is coupled to the delta plate at an additional position, and the additional position is further from the second end than the first end.

18. The heat exchanger of claim 17, comprising a central axis extending across the delta plate from the vertex to the second end of the delta plate and forming a substantially right angle with the second end of the delta plate, wherein the central axis does not overlap with the refrigerant sensor, and the central axis overlaps with the refrigerant leak mitigation control board assembly.

19. The heat exchanger of claim 14, wherein the heat exchanger is configured to operate as an evaporator in at least one operating mode of the indoor unit.

* * * * *